US011674740B2

(12) United States Patent
Trammell et al.

(10) Patent No.: US 11,674,740 B2
(45) Date of Patent: Jun. 13, 2023

(54) DRAIN PAN FOR HVAC SYSTEM

(71) Applicant: Johnson Controls Technology Company, Auburn Hills, MI (US)

(72) Inventors: Curtis A. Trammell, Newcastle, OK (US); John L. McElvany, Norman, OK (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 459 days.

(21) Appl. No.: 16/723,255

(22) Filed: Dec. 20, 2019

(65) Prior Publication Data

US 2021/0190408 A1 Jun. 24, 2021

(51) Int. Cl.
*F25D 21/14* (2006.01)
*F24F 13/22* (2006.01)

(52) U.S. Cl.
CPC ..... *F25D 21/14* (2013.01); *F24F 13/222* (2013.01); *F25D 2321/145* (2013.01)

(58) Field of Classification Search
CPC ..... F25D 21/14; F25D 2321/145; F25D 2321/146; F25D 2321/143; F24F 13/222; F24F 2013/227; F24F 13/22; F28F 17/005
See application file for complete search history.

(56) References Cited

U.S. PATENT DOCUMENTS

| | | | | |
|---|---|---|---|---|
| 5,904,053 | A | 5/1999 | Polk et al. | |
| 6,112,536 | A | 9/2000 | Hansen | |
| 6,360,911 | B1 | 3/2002 | Arnold | |
| 6,868,689 | B1 * | 3/2005 | McNeil | F24F 13/222 62/288 |
| 6,895,770 | B1 | 5/2005 | Kaminski | |
| 6,901,766 | B1 | 6/2005 | Jin et al. | |
| 6,978,909 | B2 | 12/2005 | Goetzinger et al. | |
| 7,418,826 | B2 | 9/2008 | Rios et al. | |
| 8,869,548 | B2 | 10/2014 | Piccione | |
| 2004/0250841 | A1 | 12/2004 | Kimbrough et al. | |
| 2007/0169494 | A1 * | 7/2007 | Rembold | F24F 13/222 62/80 |
| 2008/0142525 | A1 | 6/2008 | Brouillette | |
| 2014/0116657 | A1 | 5/2014 | Ritchie | |
| 2016/0209055 | A1 | 7/2016 | Gedcke et al. | |
| 2018/0017283 | A1 | 1/2018 | Stewart et al. | |
| 2019/0128560 | A1 | 5/2019 | Frederick et al. | |

FOREIGN PATENT DOCUMENTS

| | | | |
|---|---|---|---|
| EP | 714003 | A2 | 5/1996 |
| EP | 3385635 | A1 | 10/2018 |
| KR | 2005072697 | A | 7/2005 |

* cited by examiner

*Primary Examiner* — Frantz F Jules
*Assistant Examiner* — Martha Tadesse
(74) *Attorney, Agent, or Firm* — Fletcher Yoder, P.C.

(57) ABSTRACT

The present disclosure relates to a heating, ventilation, and/or air conditioning (HVAC) system that includes a drain pan. The drain pan is configured to collect condensate into a basin of the drain pan from an evaporator of the HVAC system and to direct the condensate from the basin via a drain port of the drain pan. A draining surface is formed in the basin and includes a compound slope including a first slope extending along a length of the drain pan and a second slope extending along a width of the drain pan. A raised surface extends from the draining surface and includes protrusions extending from a spine that extends along a side of the drain pan. The raised surface is configured to support the evaporator of the HVAC system.

16 Claims, 11 Drawing Sheets

DRAIN PAN FOR HVAC SYSTEM

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A heating, ventilation, and/or air conditioning (HVAC) system may be used to thermally regulate an environment, such as a space within a building, home, or other structure. The HVAC system may include a vapor compression system having heat exchangers, such as a condenser and an evaporator, which transfer thermal energy between the HVAC system and the environment. The HVAC system typically includes fans or blowers that direct a flow of air across the evaporator to enable refrigerant circulating through the evaporator to absorb thermal energy from the air. Accordingly, the evaporator may discharge conditioned air that may be directed into the building and used to condition spaces within the building.

In many cases, the evaporator may condense moisture suspended within the air flowing thereacross, such that a condensate is formed on an exterior surface of the evaporator. The condensate typically flows along a height of the evaporator, due to gravity, and subsequently drips into a drain pan configured to collect the condensate. The drain pan and the evaporator may collectively form part of an evaporator assembly of the HVAC system. Unfortunately, typical evaporator assemblies having conventional drain pans may be bulky and may occupy a significant amount of space within an enclosure configured to house the evaporator assembly.

SUMMARY

The present disclosure relates to a heating, ventilation, and/or air conditioning (HVAC) system. The HVAC system includes a drain pan configured to collect condensate into a basin of the drain pan from an evaporator of the HVAC system and to direct the condensate from the basin via a drain port of the drain pan. A draining surface is formed in the basin, the draining surface having a compound slope including a first slope extending along a length of the drain pan and a second slope extending along a width of the drain pan, such that the draining surface is configured to direct condensate towards the drain port. A raised surface extends from the draining surface and includes protrusions extending from a spine that extends along a side of the drain pan. The raised surface is configured to support the evaporator of the HVAC system.

The present disclosure also relates to a drain pan for a heating, ventilation, and/or air conditioning (HVAC) system. The drain pan includes a basin configured to collect condensate from an evaporator of the HVAC system. The drain pan also includes a draining surface formed in the basin and having a compound slope including a first slope extending along a length of the drain pan and a second slope extending along a width of the drain pan, such that the draining surface is configured to direct condensate towards a drain port of the basin. The drain pan further includes a raised surface extending from the draining surface and configured to support a weight of the evaporator. The raised surface includes a spine configured to extend along a length of the evaporator and configured to engage with the evaporator to substantially block air flow from passing between the evaporator and the raised surface.

The present disclosure also relates to a heating, ventilation, and/or air conditioning (HVAC) system that includes a drain pan configured to collect condensate in a basin of the drain pan from an evaporator of the HVAC system, where the evaporator is positioned partially within the basin. A draining surface is formed in the basin, the draining surface having a compound slope including a first slope extending along a length of the drain pan and a second slope extending along a width of the drain pan, such that the draining surface is configured to direct the condensate towards a drain port of the basin. A support rail is positioned within the basin and has a perforated support panel configured to support a weight of the evaporator.

BRIEF DESCRIPTION OF THE DRAWINGS

Various aspects of this disclosure may be better understood upon reading the following detailed description and upon reference to the drawings in which.

DETAILED DESCRIPTION

Figure 1:
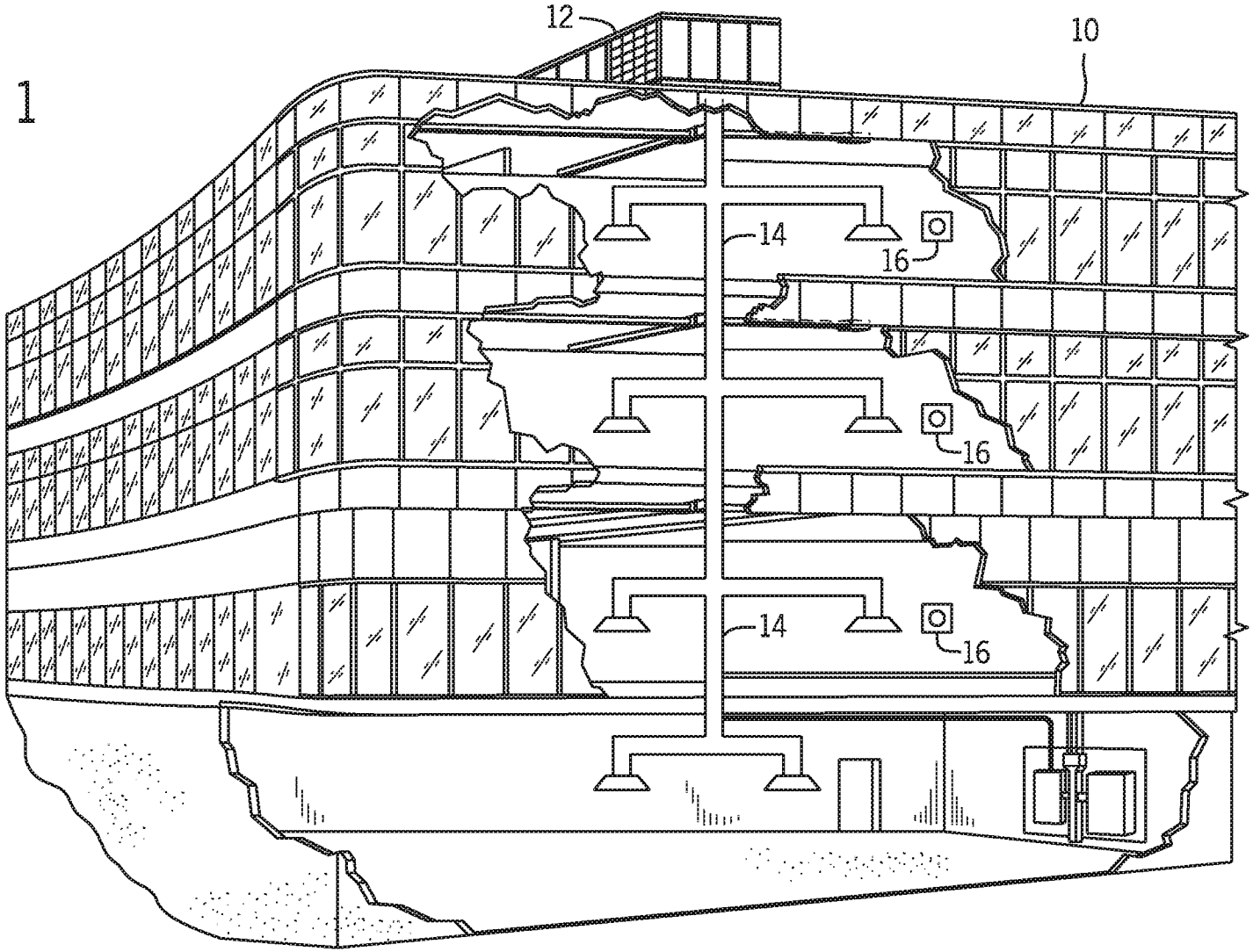
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

It should be understood that, as used herein, mathematical terms, such as "planar" and "slope," are intended to encompass features of surfaces or elements as understood to one of ordinary skill in the relevant art, and are not limited to their respective definitions as might be understood in the mathematical arts. For example, as used herein, a "planar" surface, also referred to as a "substantially planar" surface, is intended to encompass a surface that is machined, molded, or otherwise formed to be substantially flat or smooth (within related tolerances) using techniques and tools available to one of ordinary skill in the art. Similarly, as used herein, a surface having a "slope" is intended to encompass a surface that is machined, molded, or otherwise formed to be oriented at a relatively consistent incline with respect to a point of reference using techniques and tools available to one of ordinary skill in the art.

A heating, ventilation, and/or air conditioning (HVAC) system may be used to thermally regulate a space within a building, home, or other suitable structure. For example, the HVAC system generally includes a vapor compression system that transfers thermal energy between a heat transfer fluid, such as a refrigerant, and a fluid to be conditioned, such as air. The vapor compression system includes a condenser and an evaporator that are fluidly coupled to one another via one or more conduits to form a refrigerant circuit. A compressor may be used to circulate the refrigerant through the refrigerant circuit and enable the transfer of thermal energy between the condenser, the evaporator, and other fluid flows.

Generally, the evaporator of the HVAC system may be used to condition a flow of air entering a building or other structure from an ambient environment, such as the atmosphere. For example, the HVAC system may include one or more fans or blowers that direct a flow of outside air across a heat exchange area of the evaporator, such that refrigerant circulating through the evaporator may absorb thermal energy from the outside air. Accordingly, the evaporator cools the outside air before the outside air is directed into a space within the building.

In certain cases, the evaporator may condense moisture suspended within the outside air, thereby forming a condensate that may initially collect on the heat exchange area of the evaporator. The condensate typically flows along a height of the evaporator, due to gravity, and may subsequently discharge or drip from a lower end portion of the evaporator. A drain pan is generally disposed below the evaporator and is configured to collect the condensate generated during operation of the evaporator.

Conventional drain pans are typically ill-equipped to support the evaporator and/or components that may be affixed to the evaporator. Accordingly, the evaporator may be coupled to a support frame or another suitable structure that is configured to suspend the evaporator above such drain pans. The drain pan, the evaporator, and the support frame may collectively form an evaporator assembly of the HVAC system. Unfortunately, suspending the evaporator above the drain pan via the support frame may cause the evaporator assembly to occupy a relatively large amount of space within an HVAC enclosure configured to house the evaporator assembly. Accordingly, evaporator assemblies having conventional drain pans may inefficiently utilize space within the HVAC enclosure.

It is now recognized that supporting the evaporator via the drain pan reduces overall exterior dimensions of the evaporator assembly, and thus, enables more efficient space utilization within the HVAC enclosure. More specifically, it is now recognized that supporting the evaporator within a basin of the drain pan enables a reduction in an overall height of the evaporator assembly, while still enabling the drain pan to effectively collect condensate that may be generated during operation of the evaporator.

Accordingly, embodiments of the present disclosure are directed to a drain pan that is configured to support an evaporator of an evaporator assembly. For example, the drain pan may include a body that forms a basin of the drain pan. The basin includes a draining surface formed therein, which is configured to receive a condensate that may drip from the evaporator. A raised surface having one or more protrusions may extend from the draining surface and may be configured to support the evaporator within the basin. That is, a lower end portion of the evaporator may be configured to rest on the raised surface such that the drain pan supports the evaporator. Accordingly, the drain pan may collect condensate that may be generated by the evaporator while supporting the evaporator in a space-efficient manner. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
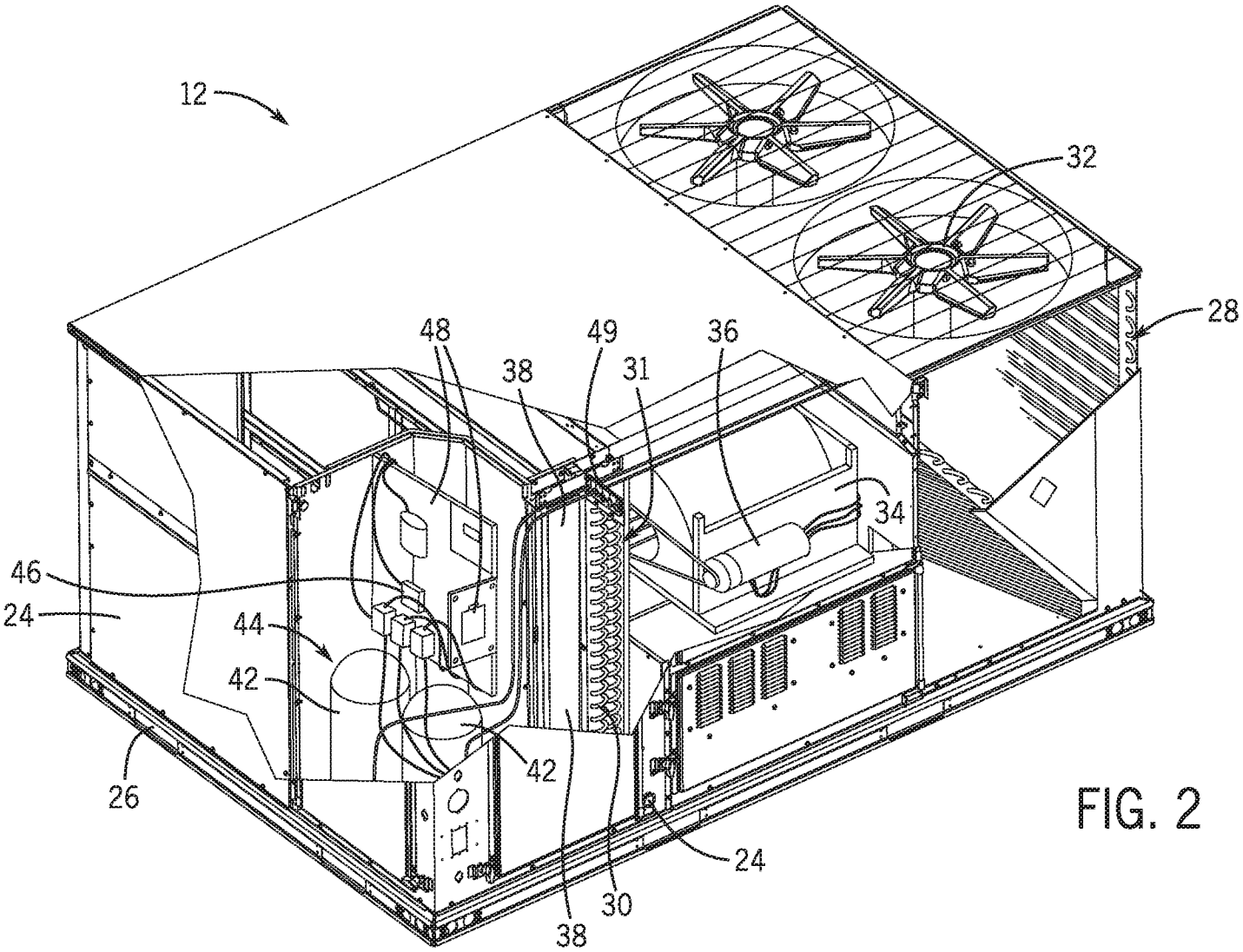
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment.

The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
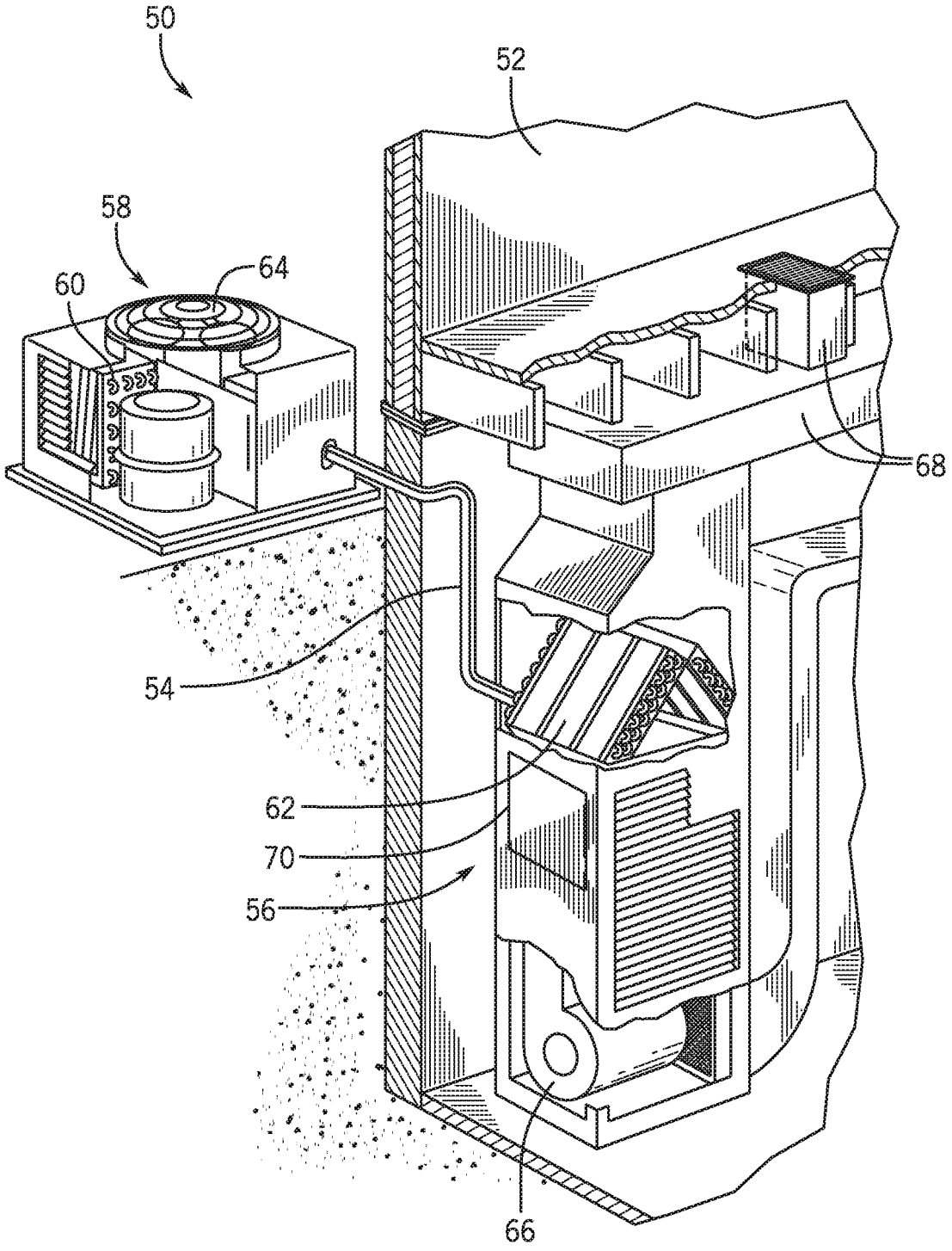
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
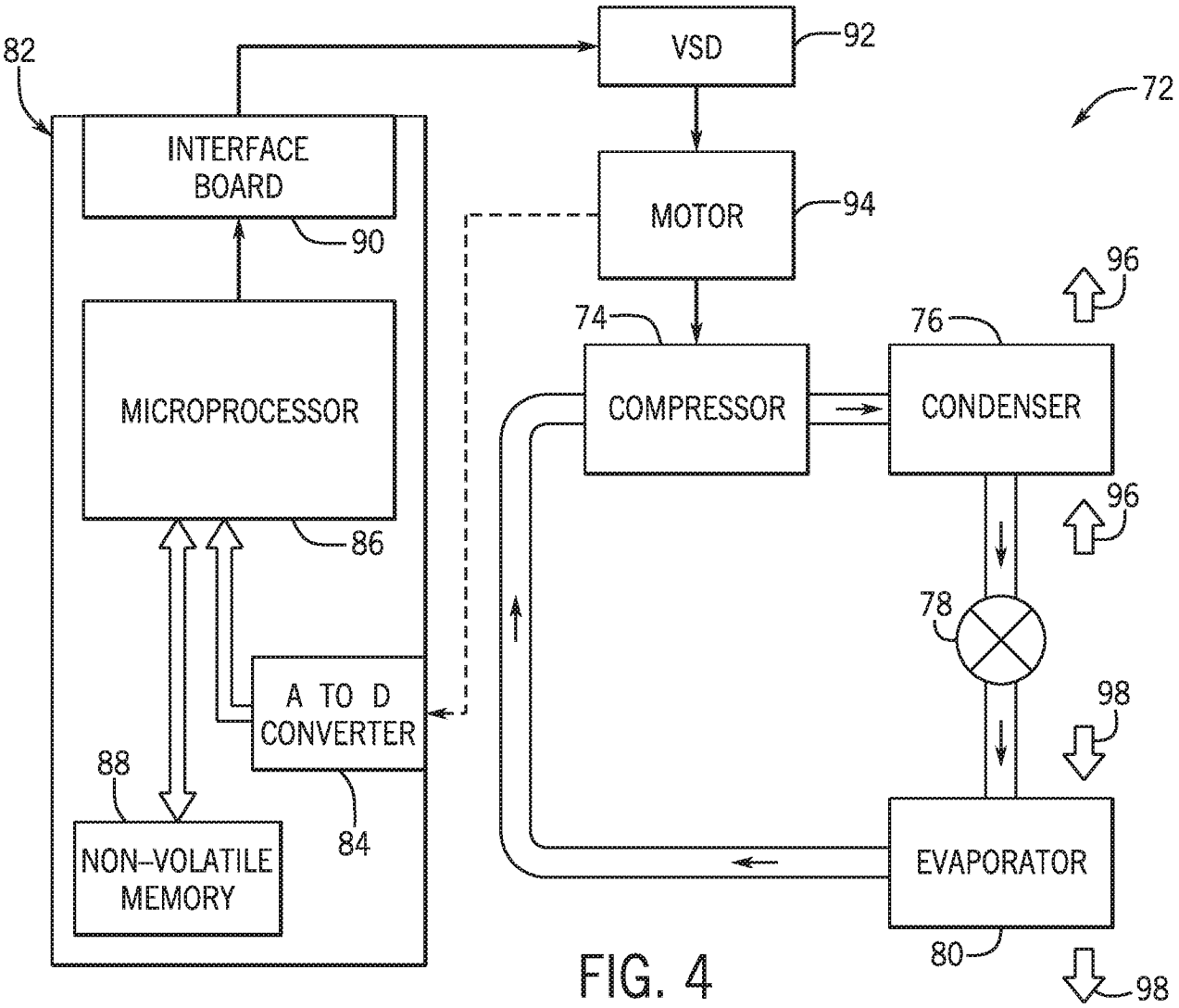
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As noted above, HVAC systems typically include a drain pan configured to collect condensate that may be generated during operation of an evaporator of the HVAC system. Conventional drains pans are generally unable to support the weight of the evaporator. Therefore, typical evaporator assemblies may include a support frame that is coupled to the evaporator and is configured to suspend the evaporator above the drain pan. As a result, such evaporator assemblies may be bulky and may occupy a relatively large amount of space within an HVAC enclosure configured to house the evaporator. Accordingly, embodiments of the present disclosure are directed toward a drain pan that is configured to support a weight of the evaporator within the HVAC enclosure in a space-efficient manner.

Figure 5:
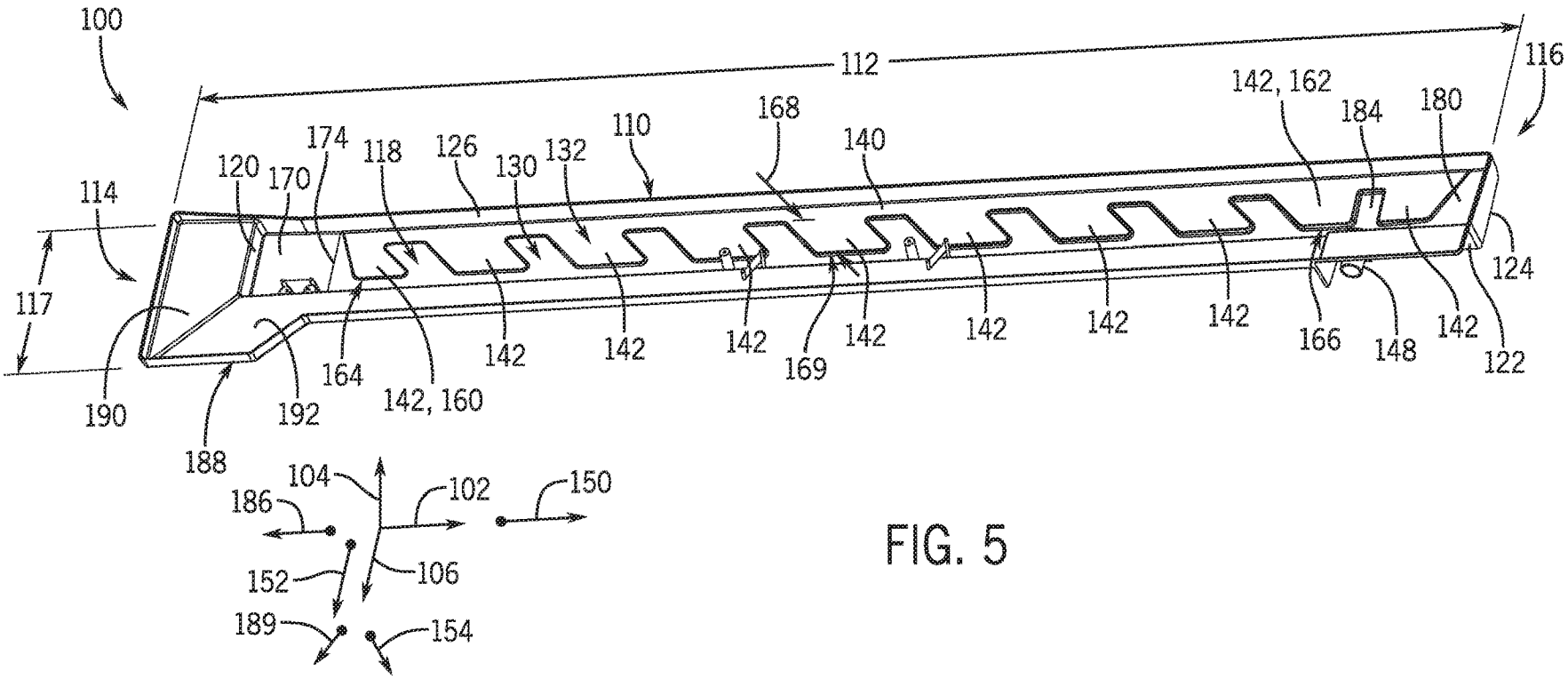
FIG. 5 is a perspective view of an embodiment of a drain pan for an HVAC system, in accordance with an aspect of the present disclosure.

With the foregoing in mind, FIG. 5 is a perspective view of an embodiment of a drain pan 100 that is suitable for supporting a heat exchanger, such as the heat exchangers 28, 30 of the HVAC unit 12 shown in FIG. 1, the evaporator 80 of the split, residential HVAC system 50 shown in FIG. 3, or another suitable heat exchanger. Indeed, it should be noted that the drain pan 100 may be included in embodiments or components of the HVAC unit 12, embodiments or components of the split, residential HVAC system 50, a rooftop unit (RTU), or any other suitable HVAC system. To facilitate discussion, the drain pan 100 and its respective components will be described with reference to a longitudinal axis 102, a vertical axis 104, which is oriented relative to gravity, and a lateral axis 106.

Figure 7:
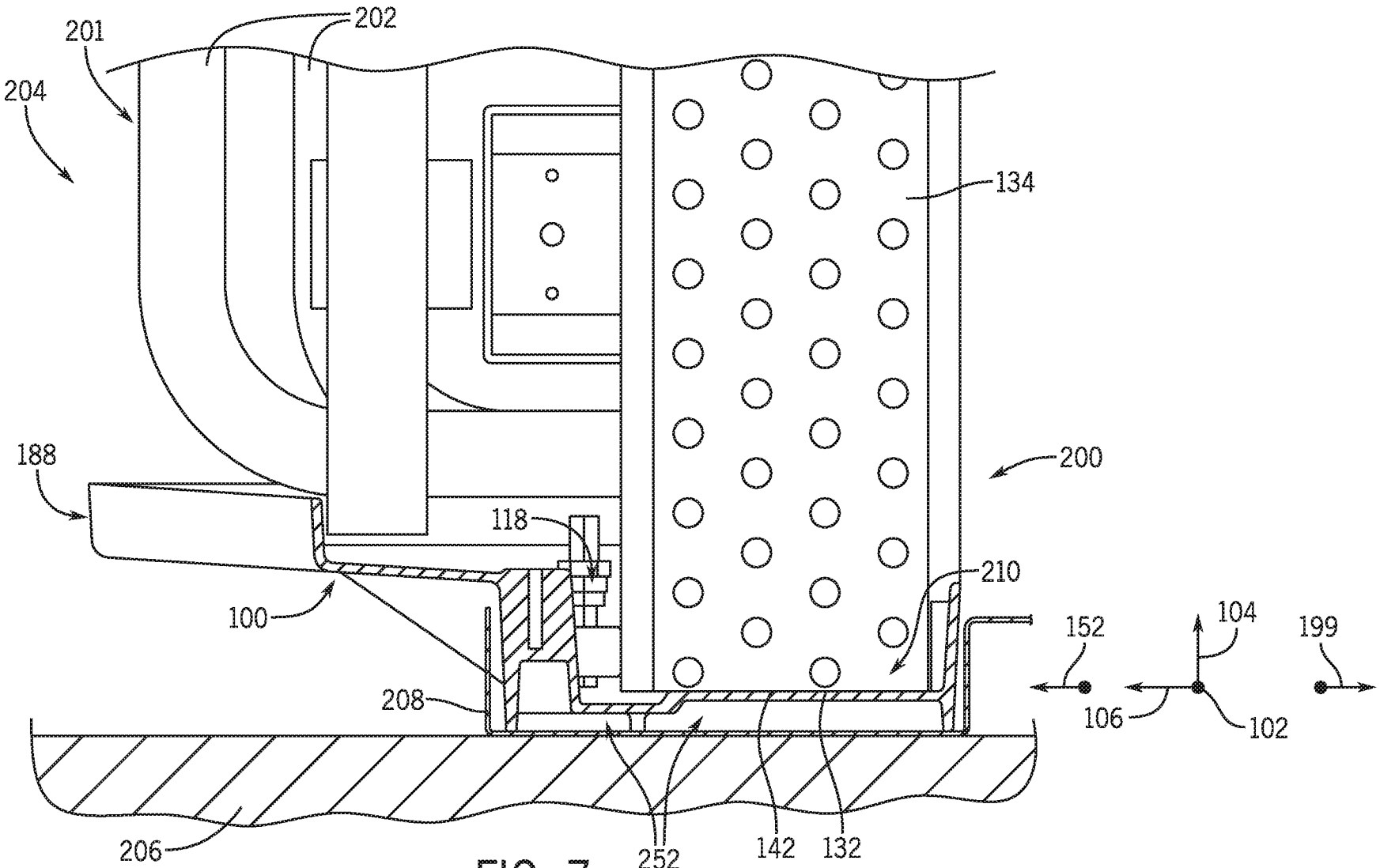
FIG. 7 is a cross-sectional side view of an embodiment of an evaporator assembly for an HVAC system, in accordance with an aspect of the present disclosure.

In the illustrated embodiment, the drain pan 100 includes a body portion 110 that extends along a length 112 of the drain pan 100 from a first end portion 114 of the drain pan 100 to a second end portion 116 of the drain pan 100. For clarity, it should be noted that the length 112 may extend generally parallel to the longitudinal axis 102, and that a width 117 of the drain pan 100 may extend generally parallel to the lateral axis 106. The body portion 110 includes a basin 118 that is defined by a first wall 120, a second wall 122, a third wall 124, and a fourth wall 126 of the body portion 110. As such, the first, second, third, and fourth walls 120, 122, 124, and 126 may define a perimeter of the basin 118. The basin 118 includes a draining surface 130 formed therein, as well as a raised surface 132 that extends from the draining surface 130. The raised surface 132 is configured to receive and engage with an evaporator 134, as shown in FIG. 7, such that the raised surface 132 supports the evaporator 134 within the basin 118.

For example, in some embodiments, the raised surface 132 may be a substantially planar surface that extends substantially level along the length 112 and the width 117 of the drain pan 100. That is, the raised surface 132 may extend substantially co-planar to a plane formed between the longitudinal axis 102 and the lateral axis 106. A lower end portion of the evaporator 134 may rest on the raised surface 132 in an installed configuration of the evaporator 134, such that the raised surface 132 may support a weight of the evaporator 134 and a weight of components that may be coupled to the evaporator 134. As such, the drain pan 100 may directly support the evaporator 134 without use of a dedicated support frame or other structure configured to suspend the evaporator 134 above the drain pan 100. As discussed below, when resting on the raised surface 132, at least a portion of the evaporator 134 may be disposed within the basin 118. As a result, the drain pan 100 may enable more space efficient installation of the evaporator 134 within an HVAC enclosure, such as the cabinet 24 of the HVAC unit 12. In particular, the drain pan 100 may enable an overall height of an evaporator assembly having the drain pan 100 and the evaporator 134 to be reduced, as compared to typical evaporator assemblies that include a support structure for suspending an evaporator above a drain pan.

In some embodiments, the raised surface 132 includes a spine 140 that extends along a portion or substantially all of the length 112 of the drain pan 100. For example, the spine 140 may extend continuously along the fourth wall 126. The raised surface 132 may include one or more protrusions 142 that extend from the spine 140 in a direction transverse to the length 112. For example, as discussed in detail below, the protrusions 142 may extend from the spine 140 generally along an angle of incline of the draining surface 130.

The draining surface 130 is configured to receive condensate that may be generated during operation of the evaporator 134 and to direct the generated condensate toward a drain port 148 of the drain pan 100. For example, the draining surface 130 may be sloped downwardly, with respect to gravity, toward the drain port 148, such that gravity may direct condensate accumulated on the draining surface 130 toward the drain port 148. In particular, the draining surface 132 may include a compound slope that extends downwardly, with respect to gravity, along the length 112 of the drain pan 100, from the first end portion 114 to the second end portion 116 of the drain pan 100, and that extends downwardly, with respect to gravity, along the width 117 of the drain pan 100, from the fourth wall 126 to the second wall 122 of the basin 118. Indeed, the compound slope may include a first slope that extends downwardly, with respect to gravity, along the longitudinal axis 102 in a first direction 150, and include a second slope that extends downwardly, with respect to gravity, along the lateral axis 106 in a second direction 152. Accordingly, the compound slope of the draining surface 130 may enable condensate dripping onto the draining surface 130 to flow generally along a direction of incline 154 of the draining surface 130, which may correlate to a magnitude of the first slope and a magnitude of the second slope of the draining surface 130.

In some embodiments, gravity may direct condensate along the draining surface 130 in the direction of incline 154 until the condensate engages with the second wall 122 of the basin 118. Upon engaging with the second wall 122, the condensate may flow generally along the second wall 122 in the first direction 150 toward the drain port 148, which may be located at a lower-most portion, with respect to gravity, of the draining surface 130. Indeed, in some embodiments, the draining surface 130 may terminate at the drain port 148. In certain embodiments, the draining surface 130 may be a substantially planar surface that is oriented to include the compound slope. In other embodiments, the draining surface 130 may include a curved surface or a contoured surface.

It should be appreciated that the protrusions 142 may be graduated in height, relative to the draining surface 130, along the length 112 and the width 117 of the drain pan 100, such that the raised surface 132 may remain substantially level, with respect to gravity, along the length 112 and the width 117. As an example, the protrusions 142 may include a first protrusion 160 that is positioned near the first end portion 114 of the drain pan 100 and a second protrusion 162 that is positioned near the drain port 148. A distal end portion 164 of the first protrusion 160 may include a first height, relative to the draining surface 130, that is less that a second height, relative to the draining surface 130, of a distal end portion 166 of the second protrusion 162. As such, by gradually increasing respective heights of the protrusions 142 along the length 112, the raised surface 132 may remain substantially level, with respect to gravity, while the draining surface 130 extends along the drain pan 100 at the compound slope. Moreover, it should be noted that a height of each of the protrusions 142, with respect to the draining surface 130, may increase along respective lengths 168 of the protrusions 142 from the spine 140 to respective distal end portions 169 of the protrusions 142.

In some embodiments, the basin 118 includes a first supplementary draining surface 170 that is positioned near the first end portion 114 of the drain pan 100 and is configured to direct condensate toward the draining surface 130. In some embodiments, the first supplementary draining surface 170 may extend from draining surface 130 to the first wall 120 of the basin 118. As such, an upper interface 174 may define a boundary between the first supplementary draining surface 170 and the draining surface 130. In some embodiments, the first supplementary draining surface 170 is oriented at an angle of incline that is substantially co-planar to the draining surface 130. In other words, the first supplementary draining surface 170 may extend along the compound slope discussed above to facilitate condensate flow along the first supplementary draining surface 170 in the direction of incline 154. In other embodiments, the first supplementary draining surface 170 includes a unidirectional slope that extends downwardly, with respect to gravity, along the length 112 of the drain pan 100, from the first wall 120 to the upper interface 174. For clarity, as used herein, a surface having a "unidirectional slope" may refer to a surface that has an angle of incline extending along the length 112 of the drain pan 100, such as from the first wall 120 to the third wall 124, or that has an angle of incline extending along the width 117 of the drain pan 100, such as from the second wall 122 to the fourth wall 124, but not along both the length 112 and the width 117 of the drain pan 100. Accordingly, in embodiments where the first supplementary draining surface 170 is oriented at a unidirectional slope that extends downwardly, with respect to gravity, from the first wall 120 to the upper interface 174, the first supplementary draining surface 170 does not slope from the second wall 122 to the fourth wall 124, or vice versa. In some embodiments, the first supplementary draining surface 170 may be a substantially planar surface.

In certain embodiments, the basin 118 includes a second supplementary draining surface 180 that is positioned near the second end portion 116 of the drain pan 100 and is configured to direct condensate toward the drain port 148. In some embodiments, the second supplementary draining surface 180 may extend from draining surface 130 to the third wall 124 of the basin 118. As such, a lower interface 184 may define a boundary between the second supplementary draining surface 180 and the draining surface 130. In some embodiments, the second supplementary draining surface 180 includes an additional compound slope that extends downwardly, with respect to gravity, along the length 112 of the drain pan 100, from the second end portion 116 toward the first end portion 114 of the drain pan 100, and that extends downwardly, with respect to gravity, along the width 117 of the drain pan 100, from the fourth wall 126 toward the second wall 122 of the basin 118. That is, the additional compound slope may be indicative of an angle of incline that includes a first slope extending downwardly, with respect to gravity, along the longitudinal axis 102 in a third direction 186 and a second slope extending downwardly, with respect to gravity, along the lateral axis 106 in the second direction 152. Accordingly, the additional compound slope of the second supplementary draining surface 180 may enable condensate on the second supplementary draining surface 180 to flow generally along an additional direction of incline 189 of the second supplementary draining surface 180 and toward the drain port 148 positioned at the lower interface 184.

It should be understood that, in other embodiments, the second supplementary draining surface 180 may include a unidirectional slope that extends downwardly, with respect to gravity, along the length 112 of the drain pan 100, from the third wall 124 to the lower interface 184. In such embodiments, the second supplementary draining surface 180 does not slope from the second wall 122 to the fourth wall 124, or vice versa. In some embodiments, the second supplementary draining surface 180 may be a substantially planar surface.

In certain embodiments, the body portion 110 includes one or more inclined flanges 188 that are disposed about a portion of or substantially all of a perimeter of the basin 118. For example, in the illustrated embodiment, the body portion 110 includes a first inclined flange 190 that extends from the first wall 120 of the basin 118 and a second inclined flange 192 that extends from the second wall 122 of the basin 118. As discussed below, the inclined flanges 188 may facilitate directing condensate into the basin 118, particularly when the condensate does not drip directly into the basin 118 from the evaporator 134.

Figure 6:
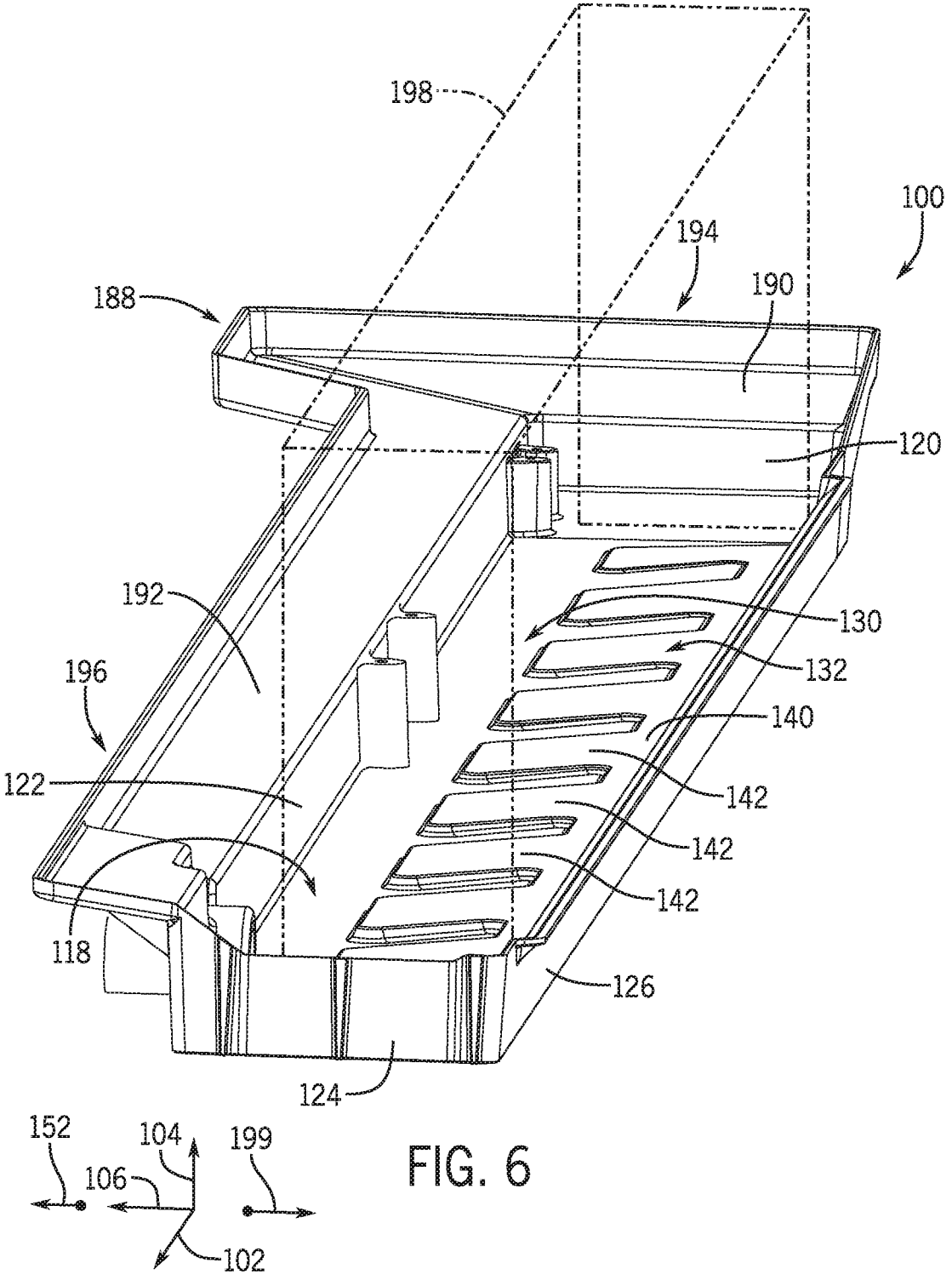
FIG. 6 is a perspective view of an embodiment of a drain pan for an HVAC system, in accordance with an aspect of the present disclosure.

To better illustrate the first and second inclined flanges 190, 192 and to facilitate the following discussion, FIG. 6 is a perspective view of an embodiment of the drain pan 100. In some embodiments, the first inclined flange 190 includes a unidirectional slope that extends downwardly, with respect to gravity, along the length 112 of the drain pan 100, from a distal end 194 of the first inclined flange 190 to the first wall 120. The second inclined flange 192 may include a unidirectional slope that extends downwardly, with respect to gravity, along the width 117 of the drain pan 100, from a distal end 196 of the second inclined flange 192 to the second wall 122. As noted above, the first and/or second inclined flanges 190, 192 may be configured to collect condensate that may not drip directly into the basin 118 during operation of the evaporator 134.

For example, when the evaporator 134, as represented by phantom lines 198, is in an installed configuration on the drain pan 100, a blower or other suitable flow generating device may be configured to direct a flow of outdoor air or another air flow across the evaporator 134 in the second direction 152 to facilitate heat exchange between refrigerant circulating through the evaporator 134 and the outdoor air. In some embodiments, the outdoor air may flow across the evaporator 134 with sufficient force to dislodge a portion of condensate that may accumulate on an exterior surface of the evaporator 134 during operation of the evaporator 134. Accordingly, the outdoor air may cast this condensate from the evaporator 134 in the second direction 152 before the condensate drips from the evaporator 134, via gravity, into the basin 118. As such, this portion of condensate may be ejected from the evaporator 134 in a generally parabolic trajectory in the second direction 152, such that the ejected condensate may be blown downstream of the basin 118. Therefore, the drain pan 100 includes, for example, the second inclined flange 192, which may be disposed downstream of the basin 118, relative to a direction of air flow across the evaporator 134, and which is configured to catch condensate that is cast from the evaporator 134 via the outdoor air. Due to the aforementioned downward slope of the second inclined flange 192, the second inclined flange 192 may direct ejected condensate that drips onto the second inclined flange 192 along a fourth direction 199 into the basin 118. That is, the second inclined flange 192 may direct ejected condensate in an upstream direction, relative to a direction of air flow across the evaporator 134, and into the basin 118.

FIG. 7 is a cross-sectional side view of an embodiment the evaporator 134 in an installed configuration 200, in which the evaporator 134 is seated on the raised surface 132 of the drain pan 100. For clarity, it should be noted that, the drain pan 100, the evaporator 134, and certain auxiliary components 201 coupled to the evaporator 134, such as one or more refrigerant tubes 202, will be collectively referred to herein as an evaporator assembly 204.

In some embodiments, the drain pan 100 may be configured to rest on a lower panel 206 of an HVAC unit, such as a lower panel of the HVAC unit 12. That is, the drain pan 100 may rest on a lower surface of the cabinet 24 or on a suitable support structure positioned within the cabinet 24. In certain embodiments, a secondary pan 208 may be positioned between the lower panel 206 and the drain pan 100. The secondary pan 208 may extend about at least a portion of an outer perimeter of the basin 118.

As briefly discussed above, in the installed configuration 200, a lower end portion 210 of the evaporator 134 may rest on the raised surface 132 of the basin 118. Accordingly, the drain pan 100 may support a weight of the evaporator 134 and the auxiliary components 201 that may be coupled to the evaporator 134. It should be appreciated that, by enabling at least a portion of the evaporator 134 to rest within the basin 118, the drain pan 100 may enable an overall height of the evaporator assembly 204 to be reduced, as compared to a height of typical evaporator assemblies having a drain pan that is not configured to support the evaporator. Indeed, typical evaporator assemblies may include a dedicated support structure that is configured to support an evaporator above a drain pan, thereby increasing an overall height of such evaporator assemblies, as compared to a height of the evaporator assembly 204.

In some embodiments, the inclined flanges 188 of the drain pan 100 may be configured to facilitate collection of condensate that may be generated by the auxiliary components 201 of the evaporator 134. For example, as shown in the illustrated embodiment, the inclined flanges 188 may be sized to extend beneath and protrude past the auxiliary components 201 of the evaporator 134. Accordingly, condensate that may form on certain of the auxiliary components 201, such as on the refrigerant tubes 202, during operation of the evaporator 134 may drip from these auxiliary components 201 onto the inclined flanges 188. As such, the inclined flanges 188 may direct such condensate toward the basin 118 and block leakage of this condensate onto the lower panel 206.

Figure 8:
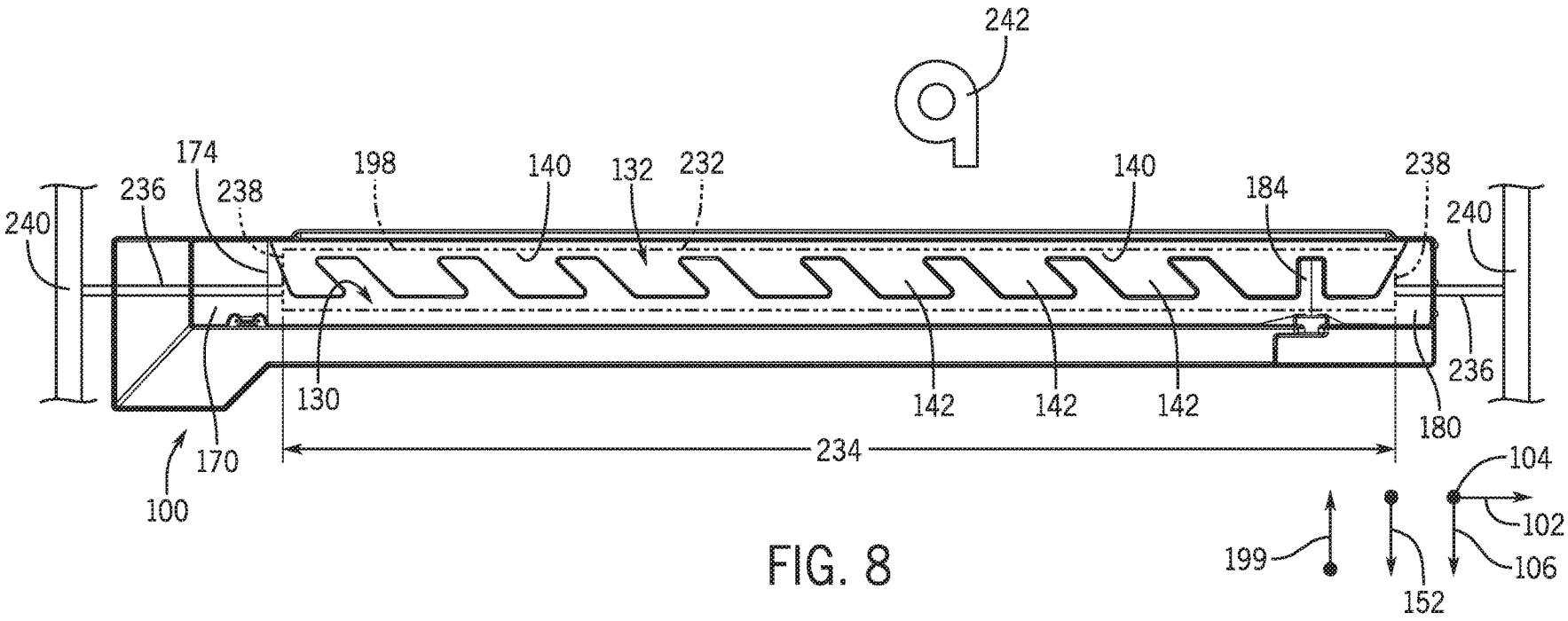
FIG. 8 is a top view of an embodiment of a drain pan for an HVAC system, in accordance with an aspect of the present disclosure.

FIG. 8 is a top view of an embodiment of the drain pan 100. As shown in the illustrated embodiment, the evaporator 134, which is represented by the phantom lines 198, may be positioned on the raised surface 132, such that an upstream edge 232 of the lower end portion 210 of the evaporator 134 is positioned on the spine 140. The spine 140 may extend continuously along a length 234 of the evaporator 134. Accordingly, engagement between the upstream edge 232 and the spine 140 may ensure that air flow between the evaporator 134 and the raised surface 132 is substantially blocked. In particular, the engagement between the upstream edge 232 and the spine 140 may ensure that air forced across the evaporator 134 in the second direction 152 by a blower 242 or other suitable flow generating device is blocked from flowing between the lower end portion 210 and the raised surface 132. In some embodiments, a suitable gasket may be positioned between the spine 140 and the lower end portion 210 to facilitate formation of a fluid seal between the spine 140 and the lower end portion 210.

In some embodiments, one or more blocking plates 236 may be configured to extend between side portions 238 of the evaporator 134 and respective side walls 240 of an HVAC enclosure configured to house the evaporator assembly 204. Additionally, the blocking plates 236 may be configured to extend between an upper end portion of the evaporator 134 and an upper panel of the HVAC enclosure. Accordingly, engagement between the evaporator 134, the spine 140, and the blocking plates 236 may ensure that substantially all of an air flow generated by the blower 242 is directed across a heat exchange area of the evaporator 134, while a marginal or substantially negligible amount of air flows between the evaporator 134, the spine 140, and/or the blocking plates 236 to bypass the heat exchange area.

Figure 9:
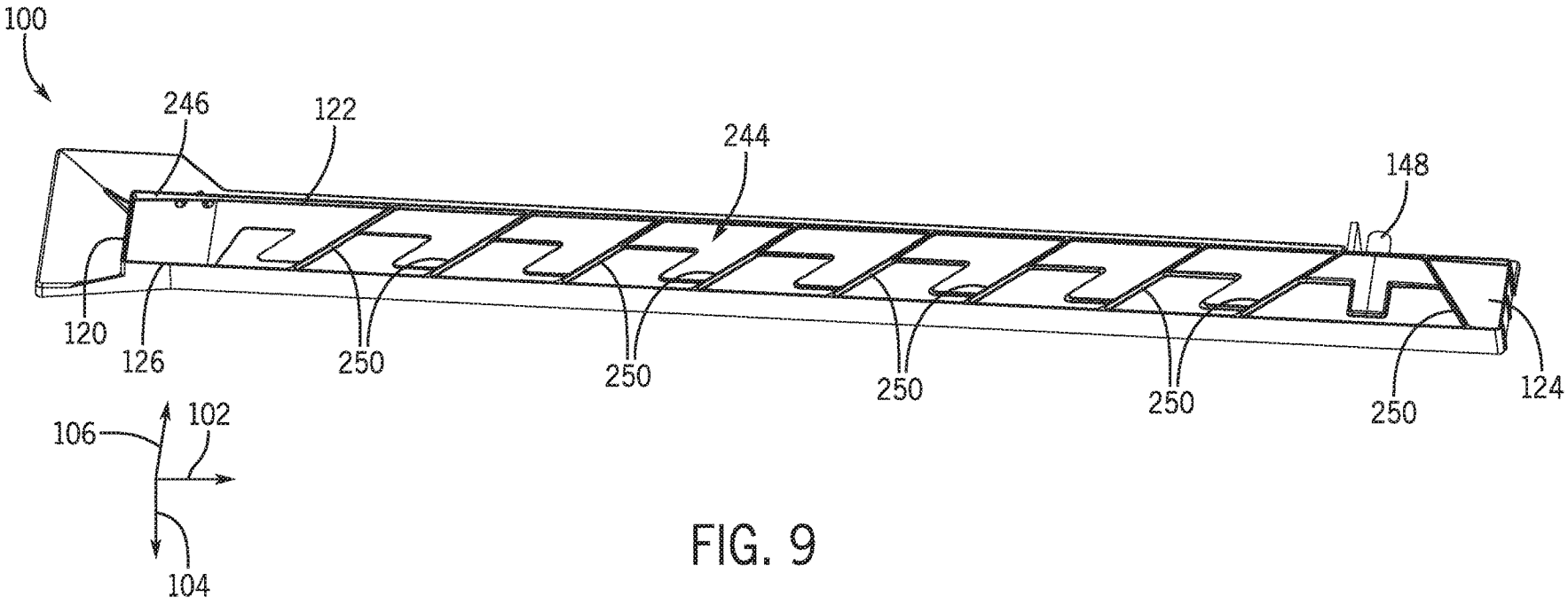
FIG. 9 is a perspective view of an embodiment of a drain pan for an HVAC system, in accordance with an aspect of the present disclosure.

FIG. 9 is a perspective view of an embodiment of the drain pan 100, illustrating an underside of the drain pan 100. In some embodiments, the first, second, third, and fourth walls 120, 122, 124, 126 of the basin 118 may protrude past a lower surface 244 of the basin 118. For clarity, the lower surface 244 may be indicative of a surface that is opposite the draining surface 130 and the raised surface 132. Accordingly, the first, second, third, and fourth walls 120, 122, 124, 126 may collectively define a lip 246 that extends along the lower surface 244 and about a perimeter of the basin 118. In some embodiments, the drain pan 100 includes a plurality of support ribs 250 that extend from the lower surface 244 and span across the lower surface 244. As an example, the support ribs 250 may span across the lower surface 244 between the second wall 122 and the fourth wall 124. However, in other embodiments, the support ribs 250 may span across the lower surface 244 in any other suitable manner or orientation. The lip 246 and/or the support ribs 250 may enhance a structural rigidity of the drain pan 100. In some embodiments, the lip 246 and the support ribs 250 may cooperate to form a plurality of cavities 252, as shown in FIG. 7, when the drain pan 100 is placed on a surface configured to support the drain pan 100. Indeed, in some embodiments, the lip 246 and distal edges of the support ribs 250 may be configured to rest on the secondary pan 208 or to rest on the lower panel 206. Accordingly, the lip 246 and the support ribs 250 may cooperate to form the cavities 252 between the drain pan 100 and the secondary pan 208 or the lower panel 206.

In some embodiments, the drain pan 100 may be formed from a polymeric piece of material via an injection-molding process or via another suitable process, such as an additive manufacturing process. For example, the drain pan 100 may be injection-molded as a single-piece component that includes the features of the drain pan 100 discussed herein. In other embodiments, that drain pan 100 may be formed from various sub-components that are assembled to collectively form the drain pan 100. For example, in certain embodiments, the drain port 148 may include a tubular structure that is formed separately of the remaining body portion 110 of the drain pan 100. In such embodiments, the drain port 148 may be coupled to a suitable aperture formed within the second wall 122 of the basin 118 during manufacture of the drain pan 100. Indeed, the drain port 148 may include exterior threads that are configured to engage with corresponding internal threads extending along an aperture formed within the second wall 122. Additionally or alternatively, suitable adhesives may be used to couple the drain port 148 to such an aperture within the second wall 122. It should be appreciated that, in some embodiments, some of the drain pan 100 or all of the drain pan 100 may be formed from a metallic material. As an example, the drain pan 100 may constructed from several pieces of sheet metal or stainless steel that are stamped to include various features of the drain pan 100 discussed above and coupled to one another via suitable adhesives, fasteners, and/or via a metallurgical process.

Figure 10:
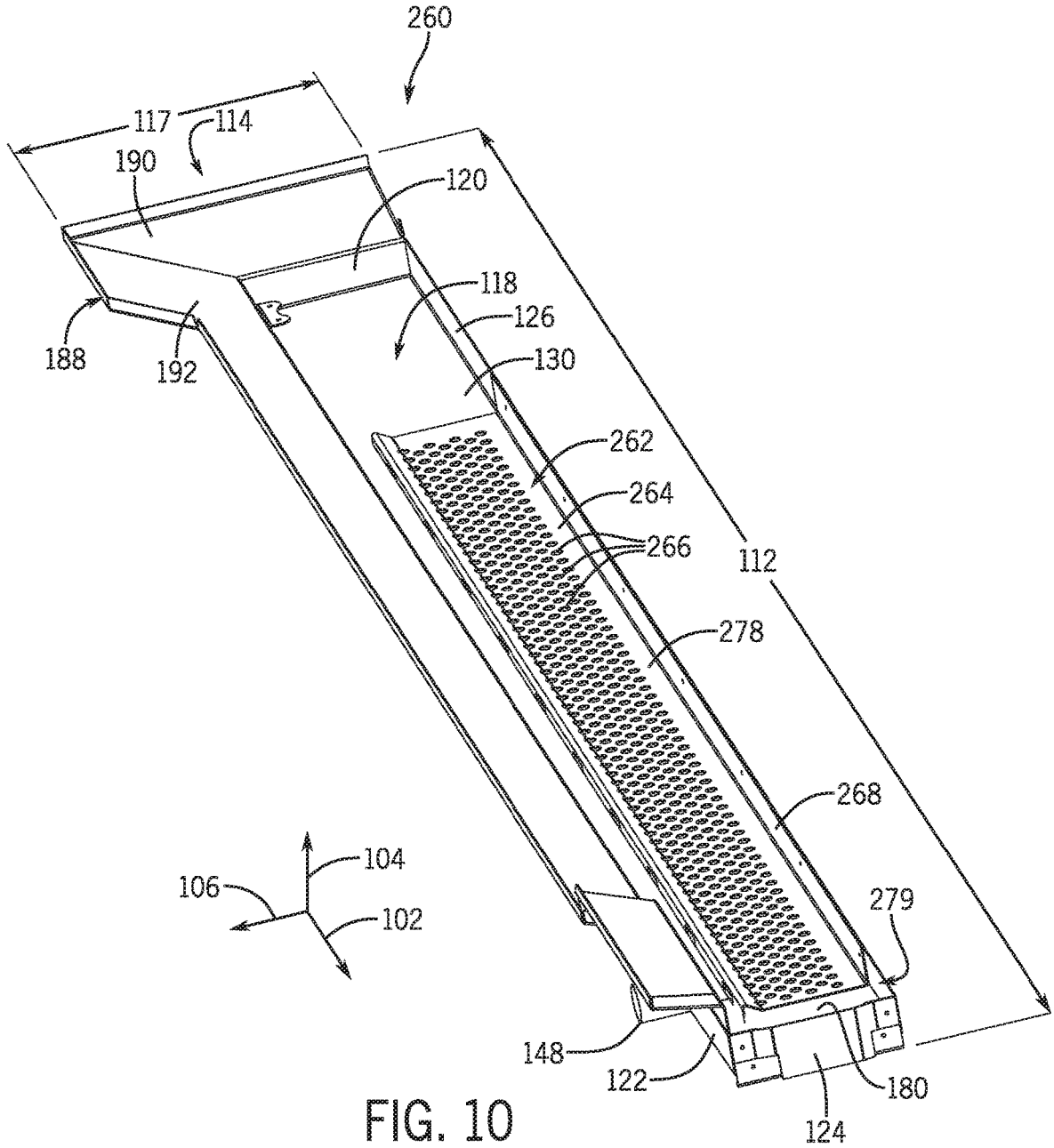
FIG. 10 is a perspective view of an embodiment of a drain pan for an HVAC system, in accordance with an aspect of the present disclosure.

FIG. 10 is a perspective view of another embodiment of the drain pan 100. In particular, FIG. 10 illustrates a drain pan 260 that includes a support rail 262 configured to support the evaporator 134 instead of the raised surface 132. Indeed, in the illustrated embodiment, the drain pan 260 includes the draining surface 130 and the second supplementary draining surface 180 without the raised surface 132 extending therefrom. The support rail 262 includes a support panel 264 that extends substantially level along the length 112 and the width 117 of the drain pan 260. In an installed configuration of the evaporator 134, the lower end portion 210 of the evaporator 134 is configured to rest on the support panel 264, such that the support rail 262 may support a weight of the evaporator 134 above the draining surface 130. The support panel 264 may include a plurality of apertures 266 or perforations formed therein, which enable condensate that may be generated by the evaporator 134 to drip through the apertures 266 and onto the draining surface 130 and/or the second supplementary draining surface 180. Accordingly, the draining surface 130 and/or the second supplementary draining surface 180 may direct the condensate toward the drain port 148.

Figure 11:
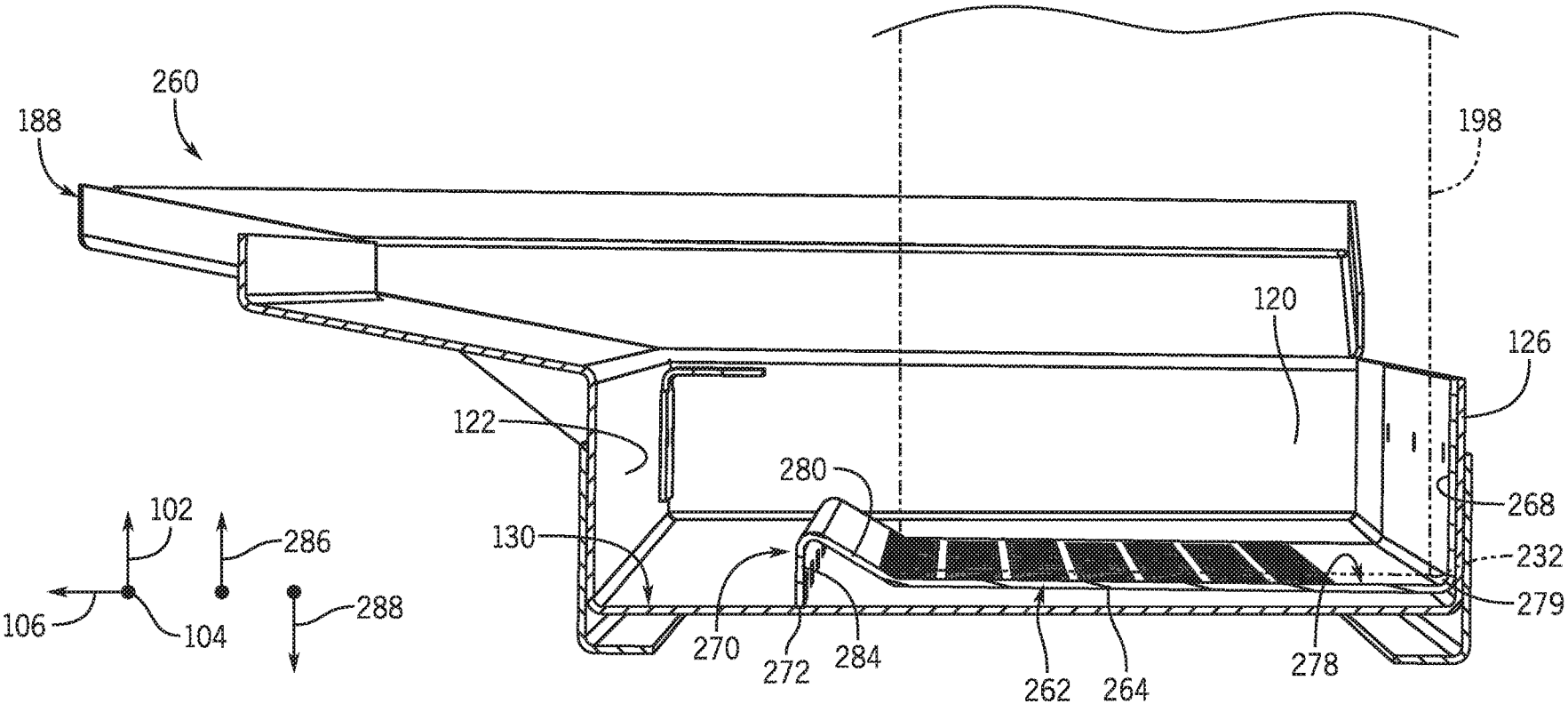
FIG. 11 is a cross-sectional side view of an embodiment of a drain pan for an HVAC system, in accordance with an aspect of the present disclosure.

To better illustrate the support rail 262 and to facilitate the following discussion, FIG. 11 is a cross-sectional side view of an embodiment of the drain pan 260. As shown in the illustrated embodiment, the support rail 262 includes a first flange 268 that extends from a first end of the support panel 264 and a second flange 270 that extends from a second end of the support panel 264. The first flange 268 is configured to couple to the fourth wall 126 of the basin 118 via fasteners, adhesives, or via a metallurgical process, such as welding or brazing. The second flange 270 is configured to rest on the draining surface 130. Accordingly, the first and second flanges 268, 270 may cooperate to support the support panel 264 above the draining surface 130.

It should be noted that a distal end 272 of the second flange 270 may include a sloped or contoured profile that is configured to align or match with the compound slope of the draining surface 130 and/or the additional compound slope of the second supplementary draining surface 180. Accordingly, the second flange 270 may engage with the draining surface 130 and/or the second supplementary draining surface 180 along the length 112 of the drain pan 100 to support the support panel 264, while enabling the support panel 264 to remain at a substantially level orientation.

In some embodiments, the support panel 264 includes a spine 278, as also shown in FIG. 10, which extends along an upstream end 279 of the support panel 264, proximate to the first flange 268. Particularly, the spine 278 may include a portion of the support panel 264 that extends along the first flange 268 and that does not include any of the apertures 266 or perforations formed therein. Similarly to the spine 140 of the raised surface 132 discussed above, the spine 278 of the support panel 264 may be configured to overlap with the upstream edge 232 of the lower end portion 210 of the evaporator 134, represented by the phantom lines 198, such that engagement between the upstream edge 232 and the spine 278 may substantially block air flow between the evaporator 134 and the support rail 262. Indeed, it should be understood that the spine 278 and the upstream edge 232 may engage continuously along the length 234 of the evaporator 134.

In some embodiments, the second flange 270 includes an inclined portion 280 that extends from the support panel 264 in an upward direction, with respect to gravity. The inclined portion 280 may facilitate alignment of the evaporator 134 on the support panel 264 when the evaporator 134 is lowered into the basin 118 and onto the support rail 262. In some embodiments, the second flange 270 may include a leg portion 284 that extends from the inclined portion 280 to the distal end 272 in a fifth direction 286 that may be generally opposite to a sixth direction 288 along which the first flange 268 extends from the support panel 264.

In some embodiments, the support rail 262 may be formed from a metallic piece of material. For example, the support rail 262 may be formed from a single piece of metallic material, such as stainless steel or sheet metal, which is bent or deformed into the shape of the support rail 262. Moreover, in some embodiments, the drain pan 260 may be constructed of one or more pieces of metallic material including, for example, stainless steel. However, it should be understood that, in other embodiments, the drain pan 260 and/or the support rail 262 may be constructed from any other suitable material or materials, such as a polymeric material.

As set forth above, embodiments of the present disclosure may provide one or more technical effects useful for supporting an evaporator via a drain pan to enable space efficient mounting of the evaporator within an enclosure of an HVAC system. In particular, embodiments of the drain pans 100, 260 discussed herein enable a portion of the evaporator 134 to be supported within the basin 118 without additional support structures, thereby enabling the drain pans 100, 260 to reduce an overall height of the evaporator assembly 204, while still enabling effective collection of condensate that may be generated during operation of the evaporator 134. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

a drain pan configured to collect condensate into a basin of the drain pan from an evaporator of the HVAC system and direct the condensate from the basin via a drain port of the drain pan;

a draining surface formed in the basin, the draining surface having a compound slope including a first slope extending along a length of the drain pan and including a second slope extending along a width of the drain pan such that the draining surface is configured to direct condensate towards the drain port; and a raised surface extending from the draining surface, wherein the raised surface comprises a spine extending along a side of the drain pan and comprises protrusions extending from the spine, wherein the spine and the protrusions are configured to support the evaporator of the HVAC system.

2. The HVAC system of claim 1, wherein the draining surface is substantially planar.

3. The HVAC system of claim 1, wherein the spine of the raised surface extends continuously along the length of the drain pan and the protrusions extend from the spine in a direction transverse to the length of the drain pan.

4. The HVAC system of claim 1, wherein the protrusions are graduated in height relative to the draining surface along the length of the drain pan such that the raised surface is substantially level.

5. The HVAC system of claim 1, wherein the drain pan is injection-molded.

6. The HVAC system of claim 1, wherein the draining surface and the raised surface are formed from a metallic material.

7. The HVAC system of claim 1, wherein the draining surface terminates at the drain port.

8. The HVAC system of claim 1, wherein the basin comprises a plurality of walls that defines a perimeter of the basin and that encompasses the draining surface and the raised surface.

9. The HVAC system of claim 1, wherein the spine is configured to extend continuously along a length of the evaporator and engage with a lower end portion of the evaporator to substantially block air flow from passing between the spine and the lower end portion.

10. The HVAC system of claim 1, wherein the basin comprises a plurality of walls that extends about a perimeter of the basin, wherein an inclined flange extends from a wall of the plurality of walls and protrudes outwardly from the basin, wherein the inclined flange is positioned downstream of the evaporator, with respect to a direction of air flow across the evaporator, and is configured to receive condensate from the evaporator and to direct the condensate in an upstream direction, with respect to the direction of air flow across the evaporator, into the basin.

11. A drain pan for a heating, ventilation, and/or air conditioning (HVAC) system, comprising:

a basin configured to collect condensate from an evaporator of the HVAC system;

a draining surface formed in the basin and having a compound slope including a first slope extending along a length of the drain pan and including a second slope extending along a width of the drain pan such that the draining surface is configured to direct condensate towards a drain port of the basin; and a raised surface extending from the draining surface, wherein the raised surface comprises a spine configured to extend along a length of the evaporator and comprises protrusions extending from the spine, wherein the spine and the protrusions are configured to support a weight of the evaporator, and wherein the spine is configured to engage with the evaporator to substantially block air flow from passing between the evaporator and the raised surface.

12. The drain pan of claim 11, wherein the protrusions extend from the spine in a direction transverse to the length of the drain pan, wherein the protrusions are graduated in height along the length of the drain pan.

13. The drain pan of claim 11, comprising a first supplementary draining surface extending between a first wall of the basin and an upper interface of the draining surface and a second supplementary draining surface extending between a second wall of the basin, opposite the first wall, and a lower interface of the draining surface positioned adjacent the drain port, wherein the first supplementary draining surface is configured to direct condensate from the first wall toward the draining surface, and the second supplementary draining surface is configured to direct condensate from the second wall toward the draining surface.

14. The drain pan of claim 13, wherein the first supplementary draining surface comprises a unidirectional slope that extends along the length of the drain pan from the first wall to the upper interface, such that the first supplementary draining surface does not slope along the width of the drain pan.

15. The drain pan of claim 13, wherein the second supplementary draining surface comprises an additional compound slope including a third slope extending along the length of the drain pan and including the second slope extending along the width of the drain pan.

16. The drain pan of claim 11, wherein the draining surface and the raised surface are substantially planar surfaces.

* * * * *